United States Patent [19]

Wada et al.

[11] Patent Number: 4,783,582

[45] Date of Patent: Nov. 8, 1988

[54] MICROWAVE HEATING APPARATUS FOR USE IN AUTOMATIC VENDING MACHINE

[75] Inventors: Kikuo Wada, Hoya; Toyosi Maeda, Kadoma, both of Japan

[73] Assignees: Daito Manufacturing Co., Ltd.; Matsushita Electric Industrial Co., Ltd., both of Tokyo, Japan

[21] Appl. No.: 108,121

[22] Filed: Oct. 14, 1987

[30] Foreign Application Priority Data

Jan. 22, 1987 [JP] Japan ..... 62-11446

[51] Int. Cl.[4] ..... H05B 6/78

[52] U.S. Cl. ..... 219/10.55 R; 219/10.55 F; 221/150 A; 99/451; 99/357

[58] Field of Search ..... 219/10.55 F, 10.55 R, 219/10.55 E; 221/150 A, 150 R, 150 HC; 99/451, 357, DIG. 14

[56] References Cited

U.S. PATENT DOCUMENTS

| | | | |
|---|---|---|---|
| 3,436,506 | 4/1969 | Smith | 219/10.55 F |
| 3,867,606 | 2/1975 | Peterson | 219/10.55 R |
| 4,219,716 | 8/1980 | Kaufman, Jr. et al. | 219/10.55 R |
| 4,349,713 | 9/1982 | Marsen | 219/10.55 R X |
| 4,398,651 | 8/1983 | Kumpfer | 219/10.55 R X |

*Primary Examiner*—Philip H. Leung

*Attorney, Agent, or Firm*—Oblon, Fisher, Spivak, McClelland & Maier

[57] ABSTRACT

A heating apparatus for use in an automatic vending machine includes a heating room having an upper opening, a magnetron disposed within the heating room for generating high-frequency waves, a support shaft penetrating the bottom wall of the heating room, a receptacle connected to the upper end of the support shaft for receiving a commodity package, and a raising/lowering mechanism connected to the lower end of the support shaft for rotating and vertically moving the support shaft. The support shaft is raised by the raising/lowering and rotating mechanism to project the receptacle out of the heating room from the upper opening. Upon receipt of a commodity package, the receptacle is lowered into the heating room, and then the package is irradiated with high-frequency waves to cook the commodity therein. Upon completion of the cooking, the receptacle is again raised, and the commodity package is discharged out of the heater apparatus.

2 Claims, 11 Drawing Sheets

MICROWAVE HEATING APPARATUS FOR USE IN AUTOMATIC VENDING MACHINE

BACKGROUND OF THE INVENTION

1. Field of the Invention

This invention relates to a microwave heating apparatus for use in an automatic vending machine, which irradiates a selected commodity package with high-frequency waves to heat the selected commodity package and cook the commodity within the package.

2. Related Art Statement

Generally, a microwave oven is used as a heater in an automatic vending machine. The microwave oven has a heating room defined by walls, the rear one of which has an opening through which commodity packages are charged into the heating room. The package having a commodity cooked therein is taken out from the opening or an outlet formed in the bottom one of the walls defining the heating room. The conventional heater having the aforementioned construction makes a commodity package transporting/discharging device in an automatic vending machine complex not only in structure but also in operation. This makes the automatic vending machine liable to malfunction and difficult to miniaturize due to the bulkiness of the heater and device.

OBJECTS OF THE INVENTION

One object of this invention is to provide a microwave heating apparatus for use in an automatic vending machine, which is simple in construction and capable of uniformly heating the commodity packages stored in the machine.

Another object of this invention is to provide a microwave heating apparatus for use in an automatic vending machine, which can contribute to miniaturization of the machine or to increase the number of the commodity packages stored in the machine.

SUMMARY OF THE INVENTION

To attain the objects described above, according to this invention, there is provided a microwave heating apparatus for use in an automatic vending machine, comprising walls defining a heating room, an upper one of the walls having an opening formed therein and provided with an openable cover for covering the opening, a magnetron disposed within the heating room for inducing high-frequency waves, a support shaft penetrating a bottom one of the walls and being capable of rotating and vertically moving, a receptacle mounted on the upper end of the support shaft for receiving a commodity package thereon, and a raising/lowering and rotating mechanism disposed below the heating room and connected to the lower end of the support shaft.

The cover is moved by driving a drive motor to open the opening of the heating room, and the receptacle is raised by the raising/lowering and rotating mechanism. In this state, a commodity package is placed on the receptacle. Then, the receptacle is lowered to a predetermined position within the heating room by the raising/lowering and rotating mechanism, and the cover is moved by the drive motor to close the opening of the heating room. In this state, while rotating the receptacle with the raising/lowering and rotating mechanism, the magnetron is operated to irradiate the commodity package with high-frequency waves, thereby cooking the commodity within the package. Subsequently, the cover is moved by the drive motor to open the opening of the heating room, the receptacle is raised by the raising/lowering and rotating mechanism, and the commodity package having the commodity cooked therein is taken out of the heater.

According to this invention, therefore, a commodity package can be transported to and discharged from the heating room merely by forming the opening in the upper wall of the walls which define the heating room and vertically moving the support shaft which supports the receptacle thereon. Thus, the microwave heating apparatus of this invention is simpler in structure than the microwave oven conventionally used in an automatic vending machine, and the space occupied by the microwave heating apparatus of this invention becomes small, thereby making it possible to increase the number of commodity packages stored in the automatic vending machine or to miniaturize the machine per se.

The above and other objects and features of the invention will become more apparent from the following detailed description with reference to the accompanying drawings.

DETAILED DESCRIPTION OF THE PRESENTLY PREFERRED EMBODIMENT

The drawings illustrate an embodiment of the microwave heating apparatus according to the invention applied to an automatic popcorn vending machine.

Figure 1:
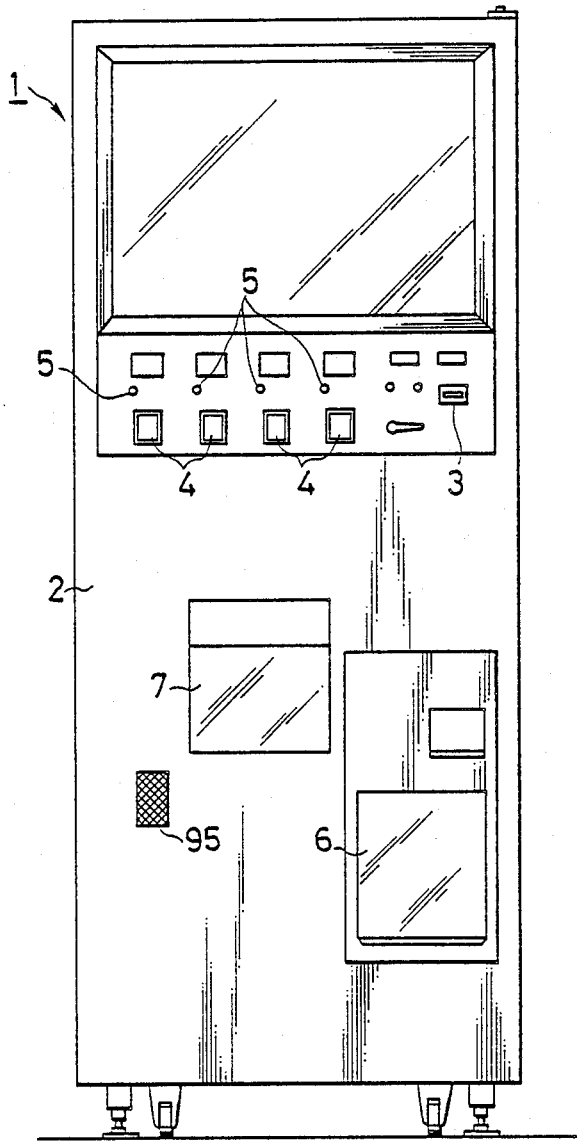
FIG. 1 is a front view illustrating an automatic vending machine which is provided with one embodiment of the microwave heating apparatus according to this invention.
Figure 2:
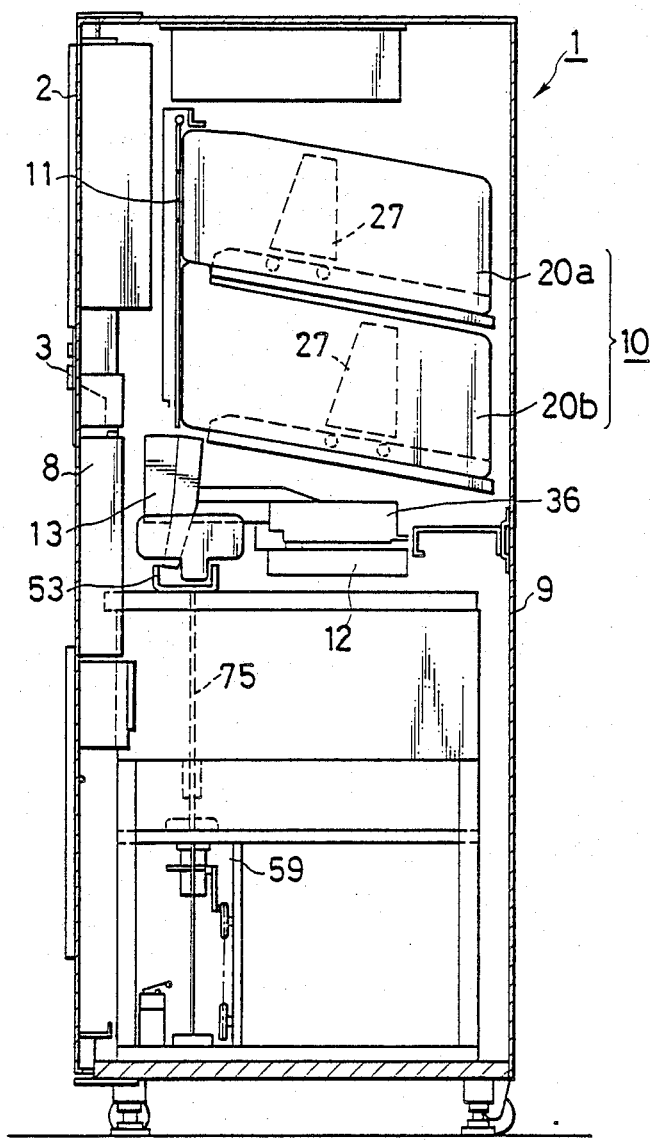
FIG. 2 is a cross section illustrating the inside of the automatic vending machine shown in FIG. 1.
Figure 3:
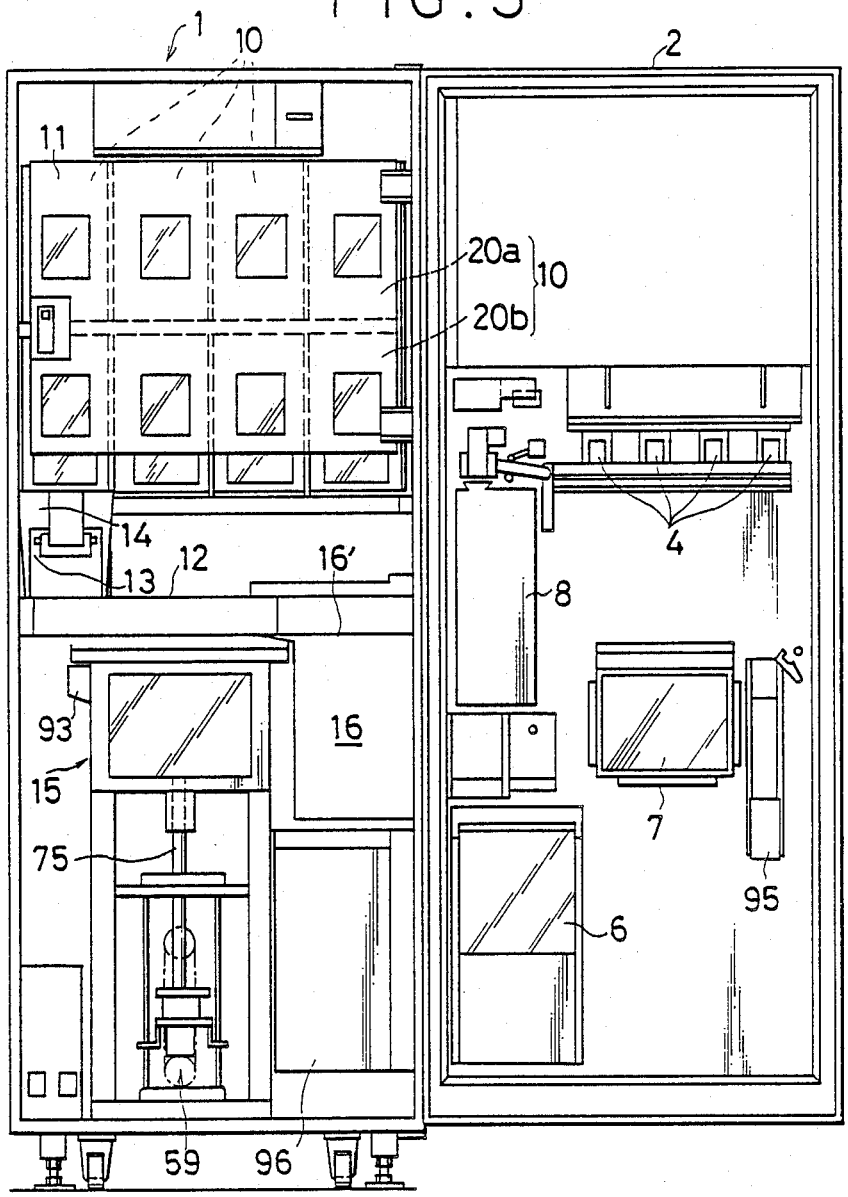
FIG. 3 is a front view illustrating the automatic vending machine shown in FIG. 1, with a front door thereof opened.

As shown in FIG. 1, an automatic popcorn vending machine 1 has a hinged front door 2 and a machine body 9. The front side of the front door 2 is provided with a coin slot 3, a plurality of commodity selection switches 4, associated sold-out lamps 5, a commodity takeout opening 6 and a window 7 for viewing the state of heating. As shown in FIG. 3, the rear side of the front door 2 is provided with a coin checker 8 or the like for checking coins inserted through the coin slot 3. In an upper portion of the interior of the machine body 9, there is provided a commodity column group consisting of a plurality of (i.e., four in this embodiment) commodity columns 10 arranged in two lateral rows. Each commodity column 10 can store a plurality of commodity packages. An inner lid 11 is hinged to the front of the column group. Beneath the column group, an elongate guide 12 extends in the direction of juxtaposition of the commodity columns 10. A transporter 13 is provided such that it is movable along the elongate guide 12. Beneath the path of travel of a package holder 14 of the transporter 13 there are provided a heating apparatus 15 and an inlet 16' of a discharging chute 16 open at one side of the heating apparatus 15.

Figure 4A:
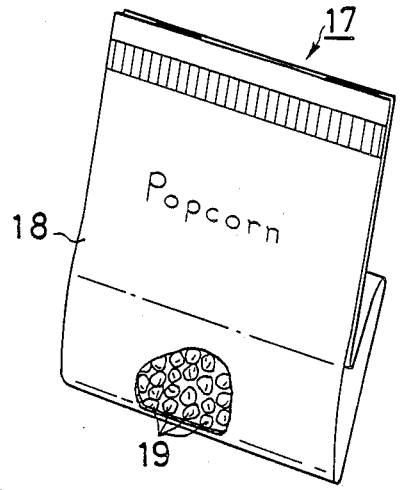
FIG. 4(A) is a perspective view illustrating one example of commodity package being stored in the automatic vending machine shown in FIG. 1 and being in a state assumed before heating.
Figure 4B:
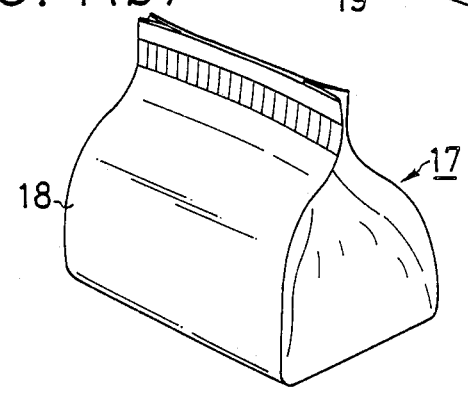
FIG. 4(B) is a perspective view illustrating the commodity package in a state assumed after heating.

A commodity package 17 is shown in FIGS. 4(*a*) and 4(*b*). It consists of a package bag 18 in which corn 19 is sealed together with cooking oil or the like. Before the commodity package is heated, it is held folded as shown in FIG. 4(*a*). When the commodity package 17 is heated, the corn 19 pops and swells as shown in FIG. 4(*b*).

Figure 5:
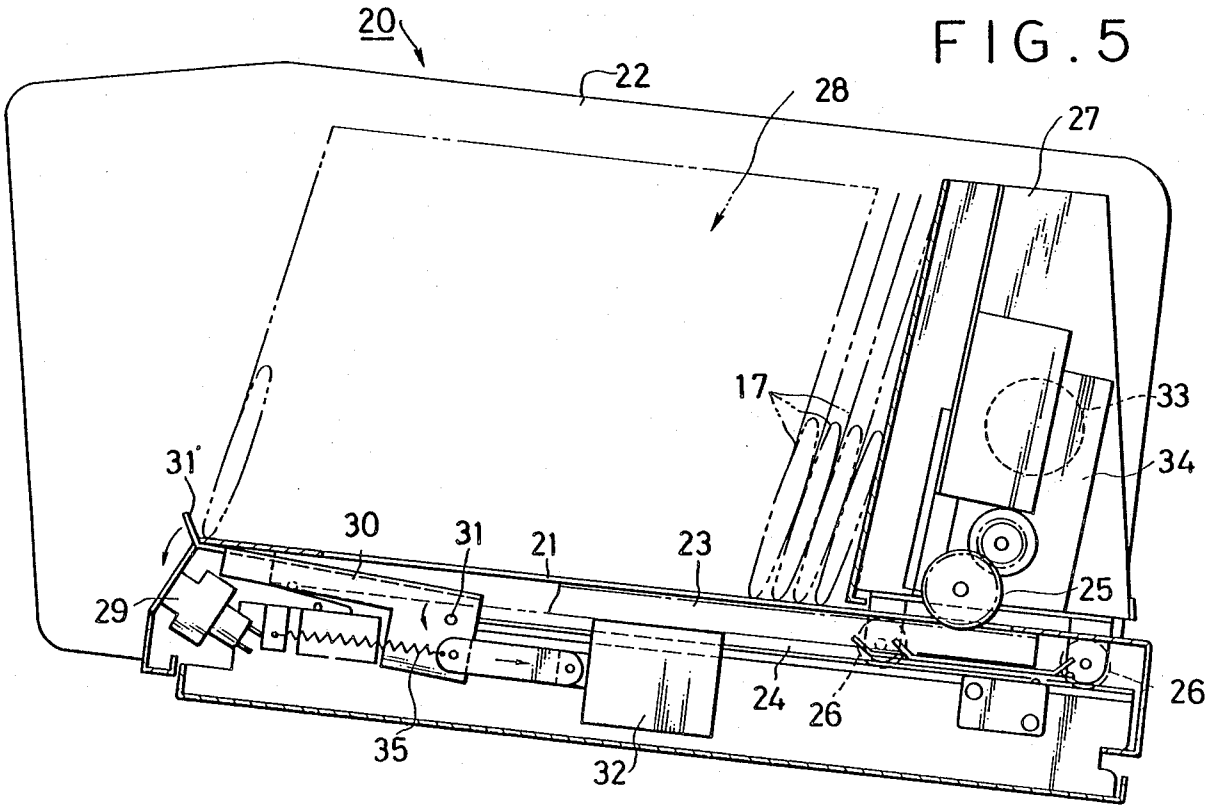
FIG. 5 is an enlarged, sectional side view illustrating a commodity column unit which stores a plurality of commodity packages therein and is accomodated in the automatic vending machine shown in FIG. 1.

Each commodity column 10 for storing a plurality of commodity packages 17 consists of upper and lower column units 20*a* and 20*b*. As shown in FIG. 5, a plurality of commodity packages 17 are stored in an upright state, stacked in the thickness direction in each column unit 20.

The column unit 20 has partition walls 22 extending upright from the opposite sides of a box-like member 21. The top of the box-like member 21 is provided with a feed-out rack gear 23 and a feed-out guide rail 24 extending in the lengthwise direction of the box-like member 21. An urging unit 27, which has a feed-out drive gear 25 meshing with the feed-out rack gear 23 and wheels 26 riding on the feed-out guide rail 24, is provided for back-and-forth movement in a storage space 28 defined by the top and opposite side partition walls 22 of the box-like member 21. A feed-out confirmation sensor 29 for sensing the passage of a commodity package 17 is provided at the free end (i.e., left end in FIG. 5) of the box-like member 21. An engagement member 30 for engaging with the foremost commodity package 17 is rotatably mounted on a shaft 31. Therefore, when a feed-out solenoid 32 is actuated by a feed-out signal (not shown) from a controller (not shown), the engagement member 30 is rotated in the direction of the arrow in FIG. 5 by the operation of the feed-out solenoid 32, and the end portion 31' of the engagement member 30 is rotated downwards to be accommodated in a lower portion of the box-like member 21. As soon as a feed-out signal has been issued from the controller, a drive motor 33 of the urging unit 27 is operated by the feed-out signal to rotate the feed-out drive gear 25 through a speed reducer 34, thereby causing a movement of the urging unit 27 toward the end of the box-like member 21 to push all the commodity packages 17 in the storage space 28 toward the end of the box-like member 21. When the commodity packages 17 are moved by the movement of the urging unit 27, the first commodity package 17 is pushed out to fall down from the end of the box-like member 21. The feed-out confirmation sensor 29 detects the commodity package 17 and supplies a stop signal to the controller. The feed-out confirmation sensor 29 may have any construction so long as it can detect a falling commodity package 17. In this embodiment, the sensor 29 consists of a light-emitting element and a light-receiving element, these elements constituting a so-called reflection type sensor which supples a signal when the light-receiving element receives light emitted from the light-emitting element and reflected by the commodity package 17.

When the controller has received the signal from the feed-out confirmation sensor 29, it stops the operation of the drive motor 33 of the urging unit 27 and deactuates the feed-out solenoid 32. When the feed-out solenoid 32 is deactuated, the engagement member 30 is upwardly rotated in the returning direction by the biasing force of a spring 35. As a result, the end portion 31' projects from the end of the box-like member 21 to engage with the first commodity package 17 in the storage space 28.

Figure 6:
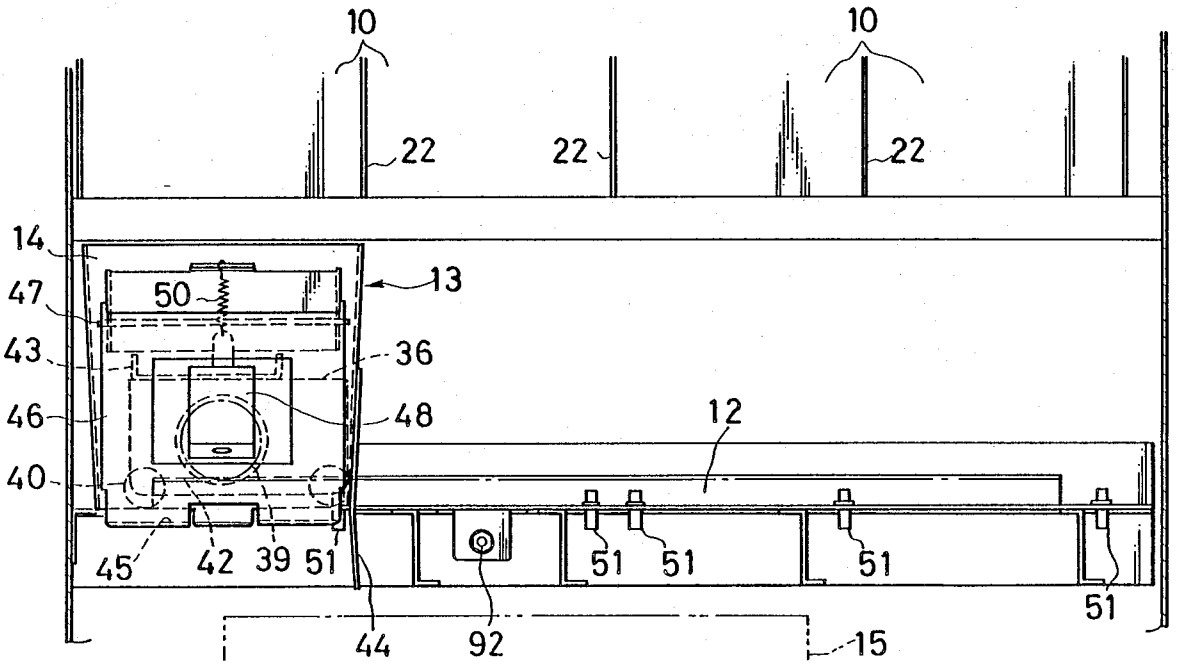
FIG. 6 is a front view illustrating a commodity package transporter accommodated in the automatic vending machine shown in FIG. 1.
Figure 7:
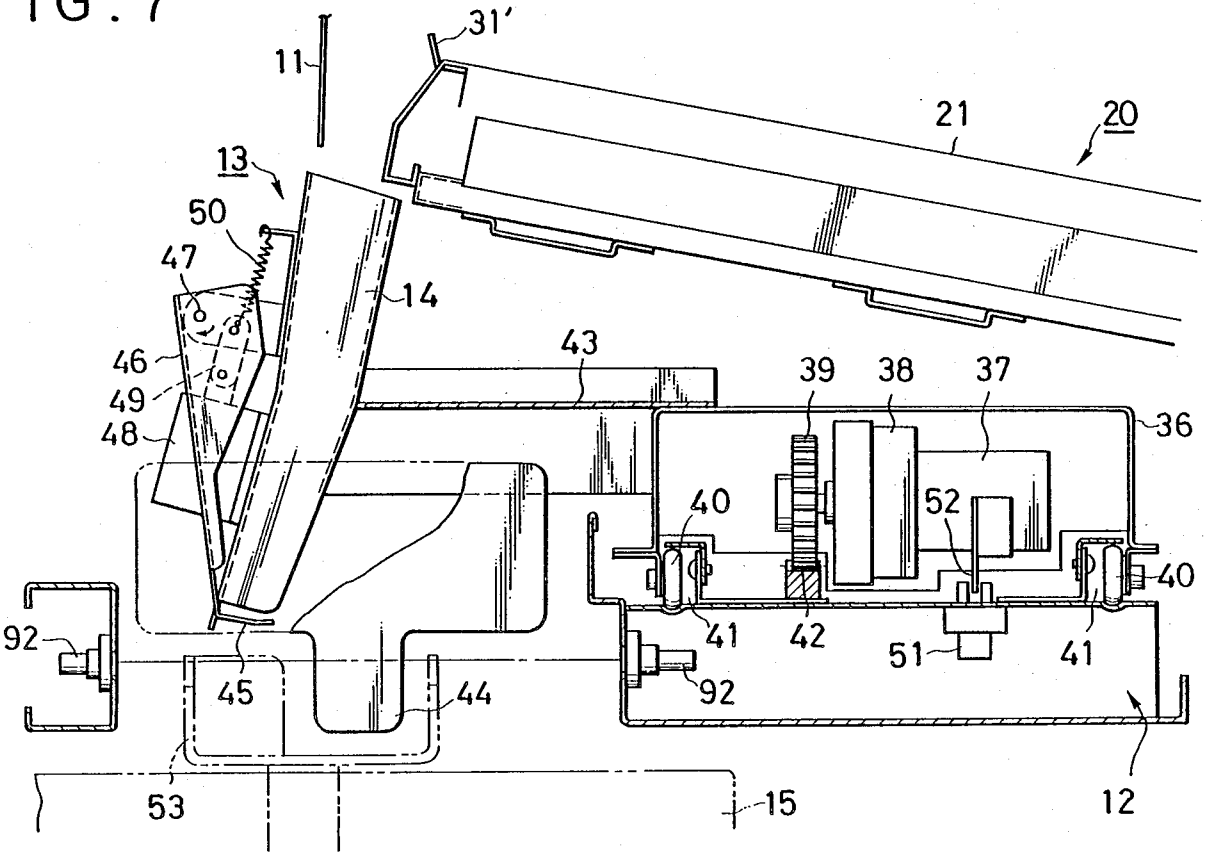
FIG. 7 is a partially sectioned side view illustrating the transporter shown in FIG. 6.

As shown in FIGS. 6 and 7, the transporter 13 for transporting the commodity packages 17 fed out from a commodity column 10 to the heating apparatus 15 has a box-like running base 36 with an inner drive motor 37. The drive motor 37 is provided with a speed reducer 38 whose output shaft has a drive gear 39. The running base 36 has wheels 40 provided at the bottom and meshing with rail grooves 41 of the elongate guide 12 provided beneath the column group. The drive gear 39 is in mesh with a transport rack gear 42 provided along the rail groove 41.

An arm 43 extends forwardly from the running base 36, and the rectangular package holder 14 open at the top and bottom is provided at the free end of the arm 43. One side of the commodity package holder 14 is provided with a platelike urging unit 44. At the front of the package holder 14, a support member 46 with a substantially horizontal support section 45 provided at the lower end is mounted rotatably about a pivot 47 so as to serve as a dropping mechanism. A stem of the support member 46 is connected to a connecting rod 49 which is in turn connected to a dropping solenoid 48. The support section 45 of the support member 46 is springbiased by a spring 50 so that it faces a lower end opening of the package holder 14.

The elongate guide 12 is provided with stop position detectors 51 in correspondence to the individual commodity columns 10 and the heater apparatus 15, as shown in FIG. 6. A downwardly directed operating plate 52 which can operate the stop position detectors 51 is provided on the running base 36. The stop position detectors 51 may be of any construction so long as they can detect the position of the transporter 13. In this embodiment, each stop position detector has a light-emitting element and a light-receiving element, these elements constituting a photosensor-type detector for supplying a signal when light is interrupted by the operating plate 52 brought to a position between the light-emitting and light-receiving elements. Therefore, when the drive motor 37 is operated by a signal from the controller, the transporter 13 is moved along the elongate guide 12 with the rotation of the drive gear 39. When the operating plate 52 acts on a predetermined stop position detector 51, the controller receives a signal from that stop position detector 51 to stop the operation of the drive motor 37, whereby the top opening of the package holder 14 may be stopped beneath the outlet of the predetermined commodity column 10 i.e., directly beneath the end of the column unit 20 corresponding to the commodity selected by a purchaser by inserting a coin or coins through the coin slot 3 and operating the commodity selection switch 4.

When a commodity package 17 is fed out from the column unit 20 in this state, the commodity package 17 is allowed to fall into the package holder 14 to be supported by the support section 45 of the support member 46. The transporter 13 is moved by operating the drive motor 37 according to a signal from the controller and stopped at a predetermined position above the heating apparatus 15. When the controller actuates the dropping solenoid 48 in this state, the support member 46 is rotated so that the support section 45 moves out of the lower end opening of the package holder 14, so that the commodity package 17 in the package holder 14 falls into a receptacle 53 of the heating apparatus 15. When the transporter 13 which has transported the commodity package 17 fed out from the column 10 to the heating apparatus 15 has caused the commodity package 17 to fall in the above way, it is moved to a stand-by position on the side (left side in FIG. 8) opposed to the discharging chute 16.

Figure 8:
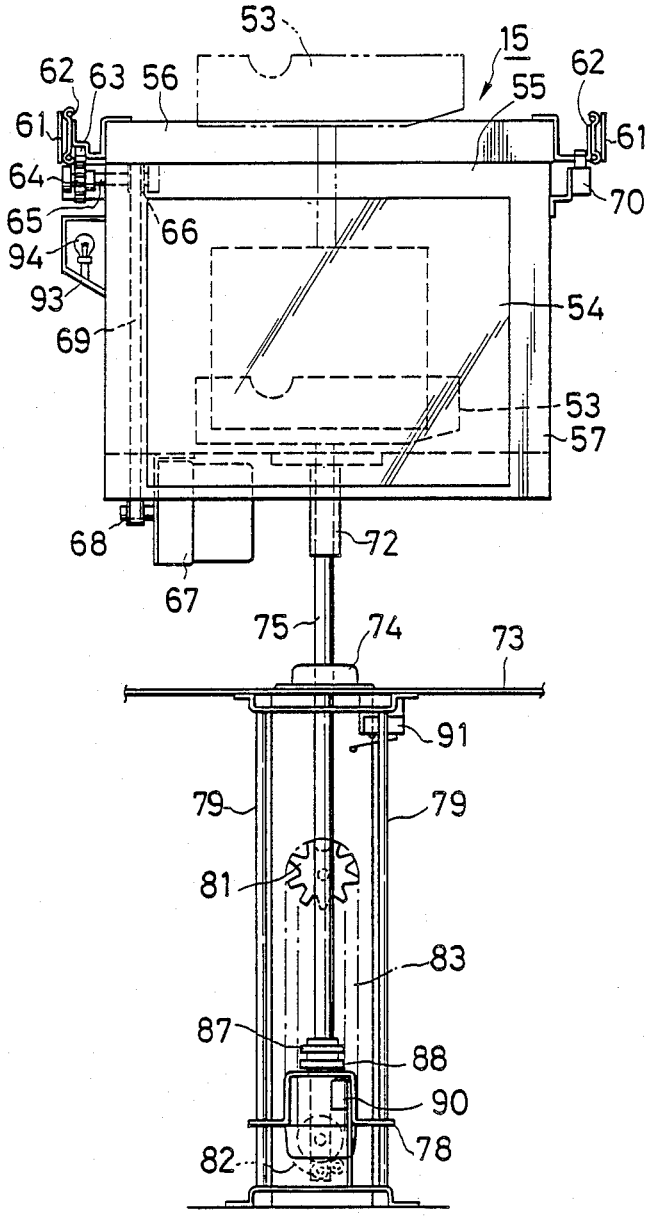
FIG. 8 is a front view illustrating one embodiment of the microwave heating apparatus according to this invention, which is provided with a raising/lowering and rotating mechanism for a commodity package and accommodated in the automatic vending machine shown in FIG. 1.
Figure 9:
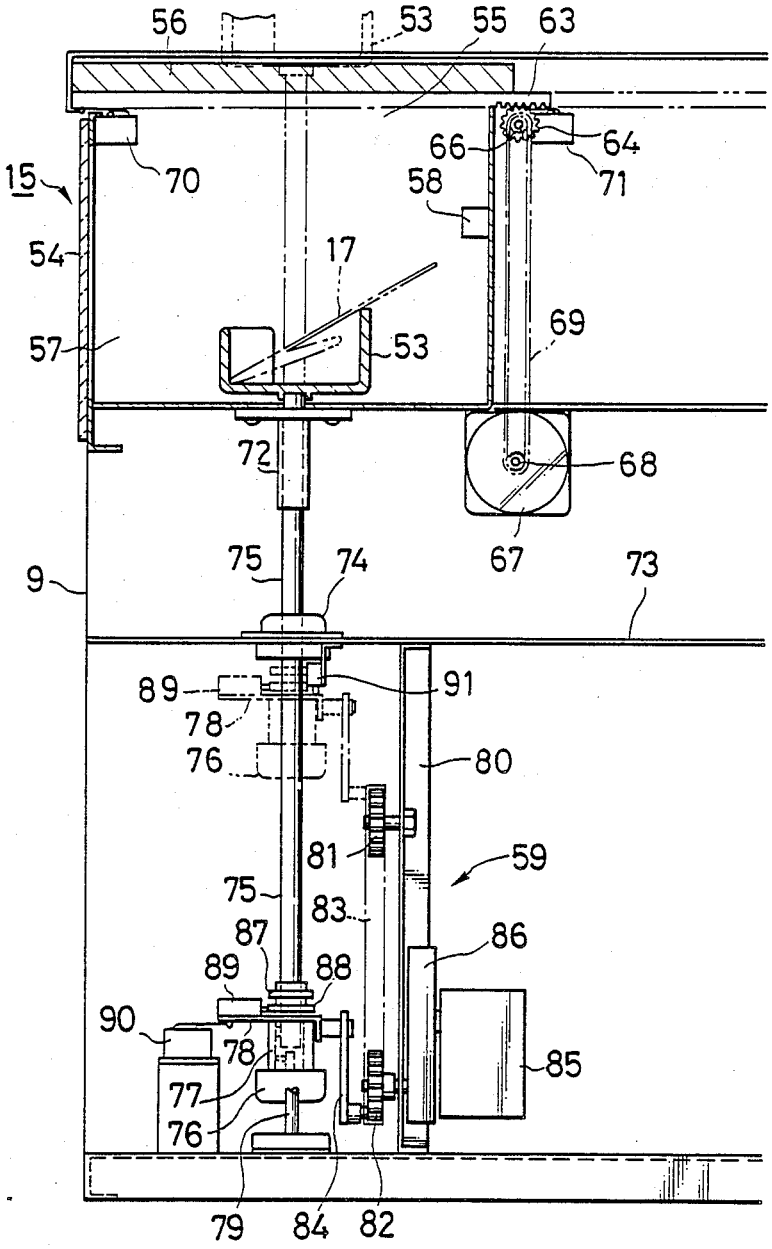
FIG. 9 is a partially cutaway side view illustrating the microwave heating apparatus shown in FIG. 8.

As shown in FIGS. 8 and 9, the heating apparatus 15 has a window 54 provided at the front, and its top is provided with an opening 55 with an openable cover 56. The heating apparatus 15 includes a heating room 57 with a magnetron 58 provided in the inside. A support shaft 75 penetrates the bottom of the heating room 57 and is capable of being rotated and vertically moved. The receptacle 53 is provided at the upper end of the support shaft 75 for supporting a commodity package 17, and a raising/lowering and rotating mechanism 59 is connected to the lower end of the support shaft 75 for rotating and vertically moving the support shaft 75. The commodity package 17 supported on the receptacle 53 is lowered with the descent of the support shaft 75 and is heated within the heating room 57 by irradiating it with high-frequency waves generated by the magnetron 58.

As shown in FIG. 8, the openable cover 56 is supported movably forward and backward by engagement between sliders 62 provided on the opposite sides of the cover 56 and cover rails 61 provided on the opposite sides of the upper surface of the heating room 57. An opening/closing rack gear 63 provided on the side of the cover 56 is in mesh with an opening/closing pinion gear 64 on the side of the heating room 57, and an endless belt 69 with a step is passed between a pulley 66 mounted on a shaft 65 of the opening/closing pinion gear 64 and a pulley 68 of an opening/closing drive motor 67. Therefore, when the opening/closing drive motor 67 is driven forwardly, the opening/closing pinion gear 64 is driven forwardly through the belt 69. With this forward driving of the opening/closing pinion gear 64, the opening/closing rack gear 63 is retreated (moved to the right side in FIG. 9) together with the cover 56 to open the top opening 55 of the heating room 57. When the opening/closing drive motor 67 is rotated reversely, the opening/closing pinion gear 64 is reversely driven to cause advance of the cover 56, thus closing the opening 55 of the heating room 57. The top of one side of the heating room 57 is provided with a closure confirmation sensor 70 and an opening confirmation sensor 71. The position of the cover 56 is detected with the sensors 70 and 71. When the cover 56 is advanced or retreated to a predetermined position, the operation of the opening/closing drive motor 67 is stopped.

In the raising/lowering and rotating mechanism 59, the support shaft 75 is supported for rotation and vertical movement in a cylindrical slide bush 72 secured to a lower portion of the heating room 57 and also in a slide bearing 74 secured to a lateral bar 73 in the machine body 9. The receptacle 53 is made of heat-resistant glass and mounted on the upper end of the support shaft 75. A drive motor 76 is connected to the lower end of the support shaft 75 with a coupling 77 and mounted on a bracket 78 having opposite side holes through which guide rods 79 are inserted. Upper and lower sprockets 81 and 82 are provided on a vertical bar 80 disposed in parallel to the guide rod 79, and a chain 83 is passed round both the sprockets 81 and 82. The bracket 78 is connected to a piece of the chain 83 through a connection arm 84. A vertical drive motor 85 is connected to the shaft of the lower sprockets 82 through a speed reducer 86. A position regulating cam 87 and a position detecting cam 88 are fixed to the lower end of the support shaft 75 so that the former is held higher in position than the latter. A position detecting sensor 89 mounted on the bracket 78 has an operating member brought into engagement with the position detecting cam 88. The position regulating cam 87 has a bore formed therein for admitting a pin (not shown) projecting downwardly from the lateral bar 73 of the machine body 9.

The receptacle 53 is lowered to the neighborhood of the bottom of the heating room 57 as shown by solid lines in FIG. 9. The bracket 78 is held stationary at a lowered position at which it acts on a lowered position sensor 90. With a signal from the controller, the cover 56 is moved to open the top opening 55 of the heating room 57, and then the vertical drive motor 85 is operated, whereby the chain 83 is driven with the rotation of the sprockets 81 and 82, thus raising the bracket 78. In consequence, the receptacle 53 at the upper end of the support shaft 75 is raised. When the receptacle 53 is raised so that it projects upwards from the opening 55 of the heating room 57 as shown by dashed line in FIG. 9, the bracket 78 acts on a raised position sensor 91 to stop the operation of the vertical drive motor 85.

When the receptacle 53 is raised up to a position above the heating room 57, the dropping solenoid 48 of the transporter 13 is actuated, causing the commodity package 17 within the package holder 14 to fall down into the receptacle 53. Package sensors 92 are provided above the heating room 57, as shown in FIGS. 6 and 7. When the sensors 92 confirm falling of the commodity package 17, they supply a signal to the controller. When the controller receives this signal, the vertical drive motor 85 is operated, causing the bracket 78 to be lowered with the rotation of the chain 83. The receptacle 53 is lowered into the heating room 57 with the commodity package 17. When the receptacle 53 has been lowered to a predetermined position, the operation of the vertical drive motor 85 is stopped by a signal from the lowered position sensor 90. Further, with the advance of the cover 56 at this time, the top opening 55 of the heating room 57 is closed.

When the receptacle 53 has been lowered and the cover 56 has closed the top opening of the heating room 57, the controller operates the drive motor 76 to cause rotation of the receptacle 53. At the same time, the magnetron 58 is operated to irradiate the rotating commodity package with high-frequency waves. Thus, the corn 19 in the commodity package 17 is caused to pop, so that the commodity package 17 swells.

In this embodiment, the heating room 57 of the heating apparatus 15 has a side provided with a duct 93 communicating with the inside. The duct 93 has a lamp 94 provided therein for illuminating the heating room 57 and has an outlet communicating with an aroma delivery opening 95 of the front door 2. Thus, the aroma at the time of the heating can be discharged to the front of the automatic vending machine 1. Further, the purchaser can confirm through the window 7 of the front door 2 and the window 54 of the heating apparatus 15 that the commodity package 17 is supplied to the heating apparatus 15 and that the commodity package 17 is caused to swell with the popping of the corn 19.

When the corn 19 has popped sufficiently, the operation of the drive motor 76 and the magnetron 58 is stopped. The receptacle 53 stops its rotation at a predetermined position by the action of the position detecting cam 88 and the position detecting sensor 89 mounted at the lower end of the support shaft 75. When heating by the heating apparatus 15 has terminated, the opening/-closing drive motor 67 and vertical drive motor 85 are operated by a signal from the controller. Thus, the cover 56 is retracted, the top opening 55 of the heating room 57 is opened, and the receptacle 53 is raised with the commodity package 17. When the receptacle 53 is raised, the pin of the machine body 9 is fitted in the bore in the position regulating cam 87 of the support shaft 75 and, as a result, the receptacle 53 is directed in a predetermined direction and stopped in that state.

When the receptacle 53 has been raised up to a predetermined height, the transporter 13 is moved by a signal from the controller. With this movement of the transporter 13, the urging unit 44 mounted on one side of the commodity package holder 14 is brought into contact with the side surface of the cooked commodity package 17, thus urging the commodity package 17 in the lateral direction. Thus, the commodity package 17 falls from above the receptacle 53 into the inlet 16' of the sidewise discharging chute 16. It falls along the discharging chute 16 down to a commodity receiving section 96 provided at the lower end of the discharging chute 16 (FIG. 3).

When the commodity package 17 has fallen down to the commodity receiving section 96, the purchaser can take out the commodity package 17 with the cooked popcorn by inserting a hand into the commodity take-out opening 6 of the front door 2.

While the above embodiment is concerned with the heating of corn, this is by no means limitative, and the invention is also applicable to the de-freezing and heating of many kinds of food e.g., hamburgers, fried potatoes, hot dogs, lunches, etc.

Figure 10:
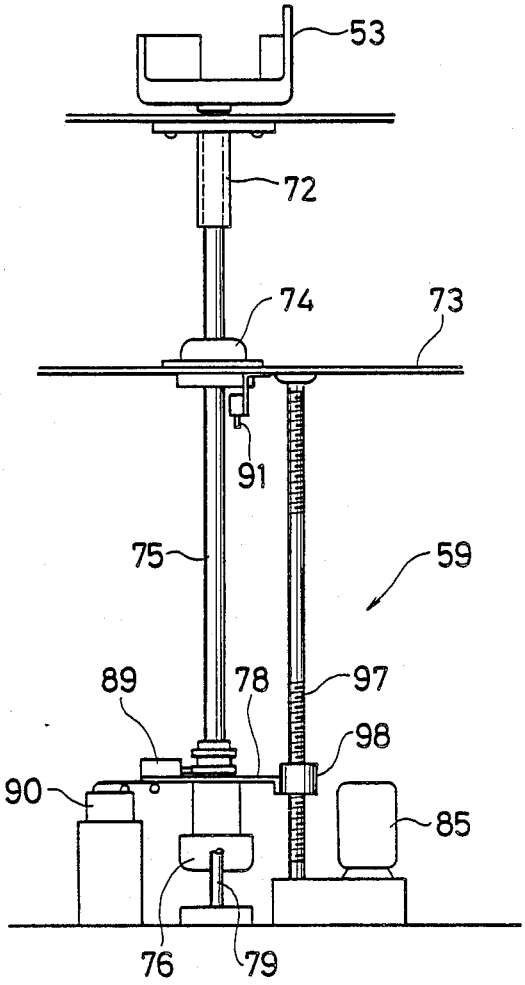
FIG. 10 is a front view illustrating another raising/lowering and rotating mechanism usable in this invention.
Figure 11:
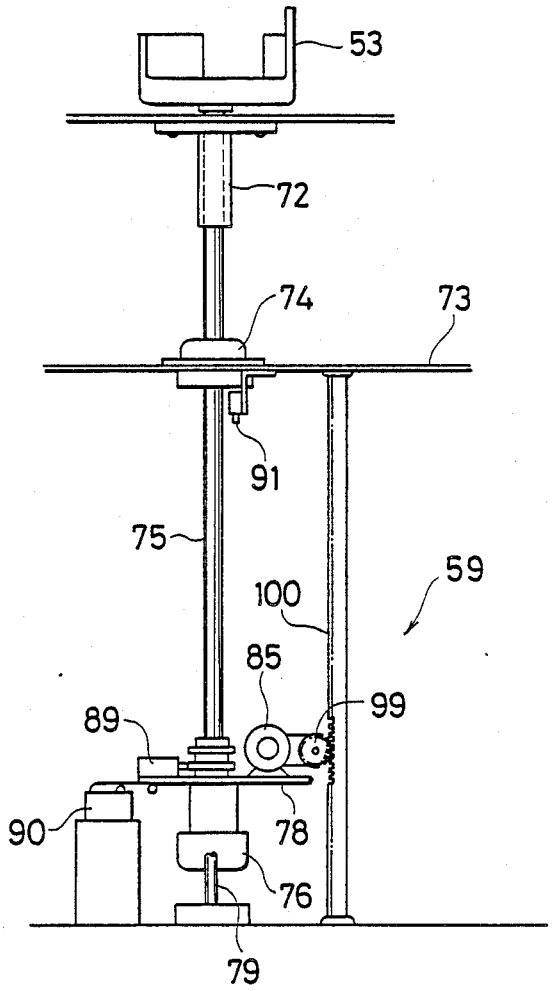
FIG. 11 is a front view illustrating still another raising/lowering and rotating mechanism usable in this invention.

Further, the raising/lowering and rotating mechanism 59 may have any other construction than that described above so long as it can rotate and vertically move the support shaft 75. For example, FIGS. 10 and 11 illustrate modified raising/lowering and rotating mechanisms 59. In FIG. 10, the mechanism 59 comprises a threaded rod 97 provided vertically and rotated by the vertical drive motor 85 and a female screw socket 98 kept in mesh with the threaded rod 97 and connected to the bracket 78, whereby the female screw socket 98 is vertically moved by the rotation of the threaded rod 97 to thereby move both the bracket 78 and the support shaft 75 in the vertical direction. In FIG. 11, the mechanism 59 comprises a pinion gear 99 disposed on the bracket 78 and rotated by the vertical drive motor 85 and a rack gear 100 vertically fixed so as to mesh with the pinion gear 99, whereby both the bracket 78 and the support shaft 75 are moved vertically by normal or reverse rotation of the pinion gear 99.

Likewise, the mechanism for moving the cover 56 may have any other construction than the drive mechanism comprising the combination of the rack gear 63 and the pinion gear 64 so long as it can move the cover 56, such as a mechanism utilizing mesh between a male screw rod and a female screw socket or a mechanism utilizing rotation of a chain, for example.

As has been described in the foregoing, according to this invention, a commodity package can be charged into or taken out of a heating room merely by forming in the upper surface of the heating room an opening which serves as inlet and outlet for the commodity package and vertically moving a support shaft which supports a receptacle thereon. Thus, the structure of the heating apparatus of this invention is simple as compared with the heaters conventionally used in an automatic vending machine. Furthermore, the movement itself of the commodity package transporting mechanism can be simplified. Therefore, an automatic vending machine is easy to assemble and less liable to malfunction.

Furthermore, according to this invention, it is only required to vertically move commodity packages in introducing the packages into or taking the packages out of a heating room. In other words, in this invention, it is unnecessary to transport commodity packages forward and backward as in the conventional heaters for use in an automatic vending machine. Therefore, the space occupied by the heating apparatus is made smaller in this invention, thereby permitting increase of the number of commodity packages stored in an automatic vending machine or size reduction of the automatic vending machine.

What is claimed is:

1. In an automatic vending machine, a microwave heating apparatus comprising:

(a) a heating room defined by top, bottom, front, rear, and side walls and provided therein with a magnetron for generating high-frequency waves, said top wall having an opening formed therein and said front walls having a window for viewing the interior of said heating room;

(b) a support shaft penetrating said bottom wall of said heating room and being rotatable and movable up and down;

(c) a receptacle mounted on the upper end of said support shaft for receiving a commodity package thereon, said receptacle being raised out of said heating room through said opening by the upward movement of said support shaft and being located at a heating position within said heating room by the downward movement of said support shaft;

(d) a raising/lowering and rotating mechanism connected to the lower end of said support shaft for rotating and moving up and down said support shaft;

(e) position detecting means mounted on said support shaft for detecting raised and lowered positions of said receptacle;

(f) means mounted on said support shaft for stopping the rotation of said support shaft by said raising/-lowering and rotating mechanism so that said receptacle is directed in a predetermined direction when the rotation of said support shaft has been stopped;

(g) a cover provided on said top wall for opening and closing said opening; and (h) means for actuating said cover to open and close said opening so that said cover opens to permit said receptacle to be raised out of said heating room and closes when said receptacle is moved to the heating position within said heating room.

2. The automatic vending machine according to claim 1 wherein one of said side walls of said heating room is provided with a duct for delivering aroma generated within said heating room to the outside of said microwave heating apparatus.

* * * * *